US008247368B2

(12) United States Patent
Danziger et al.

(10) Patent No.: US 8,247,368 B2
(45) **Date of Patent: *Aug. 21, 2012**

(54) CLEANING COMPOSITIONS COMPRISING A MULTI-POLYMER SYSTEM COMPRISING AT LEAST ONE ALKOXYLATED GREASE CLEANING POLYMER

(75) Inventors: James Lee Danziger, Mason, OH (US); Frank Hulskotter, Bad Duerkhaim (DE); Jean-Pol Boutique, Gembloux (BE); Vincent John Becks, Liberty Township, OH (US); Frederik Vandenberghe, Gentbrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/223,502

(22) Filed: Sep. 1, 2011

(65) Prior Publication Data

US 2011/0312869 A1 Dec. 22, 2011

Related U.S. Application Data

(63) Continuation of application No. 12/266,751, filed on Nov. 7, 2008, now Pat. No. 8,093,202.

(60) Provisional application No. 61/002,737, filed on Nov. 9, 2007.

(51) Int. Cl.
*C11D 3/37* (2006.01)
*C11D 3/30* (2006.01)
*C11D 1/02* (2006.01)

(52) U.S. Cl. ..... 510/499; 510/360; 510/421; 510/475; 8/137

(58) Field of Classification Search ..... 510/360, 510/421, 475, 499; 8/137
See application file for complete search history.

(56) References Cited

U.S. PATENT DOCUMENTS

| | | | | |
|---|---|---|---|---|
| 4,076,497 | A | 2/1978 | Freyberg et al. | |
| 5,565,145 | A | 10/1996 | Watson et al. | |
| 6,075,000 | A * | 6/2000 | Rohrbaugh et al. | 510/299 |
| 6,127,331 | A * | 10/2000 | Cleary et al. | 510/528 |
| 6,262,011 | B1 | 7/2001 | Boeckh et al. | |
| 7,854,771 | B2 * | 12/2010 | Boutique et al. | 8/137 |
| 7,951,768 | B2 * | 5/2011 | Boutique et al. | 510/475 |
| 2006/0234895 | A1 | 10/2006 | Souter et al. | |
| 2006/0234898 | A1 | 10/2006 | Schneiderman et al. | |
| 2007/0099815 | A1 | 5/2007 | Song et al. | |
| 2007/0105742 | A1 | 5/2007 | Scheibel et al. | |
| 2007/0275868 | A1 | 11/2007 | Cooremans et al. | |
| 2008/0153983 | A1 | 6/2008 | Boeckh et al. | |
| 2009/0014029 | A1 | 1/2009 | Borne et al. | |
| 2009/0124529 | A1 | 5/2009 | Danziger et al. | |
| 2009/0124531 | A1 | 5/2009 | Danziger et al. | |

FOREIGN PATENT DOCUMENTS

| | | | |
|---|---|---|---|
| DE | 22/27546 | A | 1/1974 |
| EP | 0359 034 | A1 | 3/1990 |
| JP | 2003/020585 | A | 1/2003 |
| WO | WO 99/67352 | A1 | 12/1999 |
| WO | WO 2006/108856 | | 10/2006 |
| WO | WO 2006/108857 | * | 10/2006 |

OTHER PUBLICATIONS

PCT International Search Report mailed Apr. 6, 2009.

* cited by examiner

*Primary Examiner* — Brian P Mruk
(74) *Attorney, Agent, or Firm* — Stephen T Murphy; Leonard W Lewis

(57) ABSTRACT

Laundry detergents and cleaning compositions which provide improved cleaning benefits that comprise a novel polymer system. The polymer system comprises one or more amphiphilic alkoxylated grease cleaning polymers, and either a clay soil cleaning polymer; or a soil suspending polymer.

14 Claims, No Drawings

CLEANING COMPOSITIONS COMPRISING A MULTI-POLYMER SYSTEM COMPRISING AT LEAST ONE ALKOXYLATED GREASE CLEANING POLYMER

CROSS REFERENCE TO RELATED APPLICATIONS

This application is a continuation application of U.S. application Ser. No. 12/266,751 filed Nov. 7, 2008 now U.S. Pat. No. 8,093,202, which claims priority to U.S. Provisional Application Ser. No. 61/002,737 filed Nov. 9, 2007.

FIELD OF THE INVENTION

The present invention is directed to laundry compositions and cleaning compositions containing a multi-polymer system comprising an amphiphilic alkoxylated grease cleaning polymer and either a clay soil cleaning polymer or a soil suspending polymer.

BACKGROUND OF THE INVENTION

Consumers desire laundry detergents including, but not limited to those in liquid and gel forms, that provide excellent overall cleaning. The detergent industry typically utilizes surfactants, among other things, to deliver this benefit. Due to increasing environmental sensitivity, as well as rising cost, the wide spread use of surfactants may be losing favor. Consequently, detergent manufacturers are examining ways to reduce the dosage of surfactant in the wash liquor, while still providing the consumer with excellent overall cleaning. However, the reduction in the levels of surfactants, especially oil-derived surfactants such as linear alkyl benzene sulfonate has been found to lead to an erosion of greasy stain removal.

Soils and stains to be removed from fabrics and other surfaces range from polar soils, such as proteinaceous, clay, and inorganic soils, to non-polar soils, such as soot, carbonblack, byproducts of incomplete hydrocarbon combustion, and organic soils. As less surfactant is available for cleaning these soils and stains, other cleaning mechanisms must be found. One approach for reducing surfactant dosage is to formulate laundry detergents with polymers. Like surfactants, polymers may be useful as releasers of soil from fabric. In addition, or in the alternative, some polymers provide for suspension of soils dispersed in the wash liquor, which in turn prevents their deposition back onto the fabrics being washed.

It would therefore be desirable to provide laundry detergent compositions comprising polymer systems that provide for good, broad-range soil cleaning of surfaces and fabrics as well as suspension of the soils. It would be even more desirable that such laundry detergent compositions would provide for good cleaning even when formulated with low levels of surfactants and organic solvents. It would also be desirable to provide these laundry detergent compositions in forms such as granules, liquids, or gels.

SUMMARY OF THE INVENTION

The present invention relates to laundry detergents and cleaning compositions which provide improved cleaning benefits that comprise a novel polymer system. The polymer system comprises one or more amphiphilic alkoxylated grease cleaning polymers, and either a clay soil cleaning polymer; or a soil suspending polymer.

The amphiphilic alkoxylated grease cleaning polymer comprises a core structure and a plurality of alkoxylate groups. The core structure may comprise either i) a polyalkylenimine structure comprising, in condensed form, repeating units of formulae (I), (II), (III) and (IV):

(I)

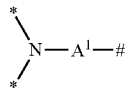

(II)

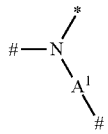

(III)

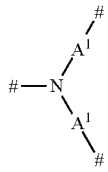

(IV)

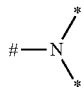

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol; or ii) a polyalkanolamine structure of the condensation products of at least one compound selected from N-(hydroxyalkyl)amines of formulae (I.a) and/or (I.b), (I.a)

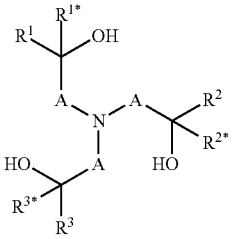

(I.b)

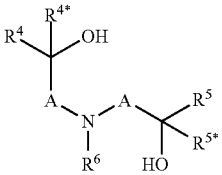

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted. The plurality of alkylenoxy groups are independently selected from alkylenoxy units of the formula (V)

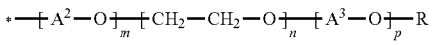

(V)

wherein: * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; in has an average value in the range of from 0 to about 2; n has an average value in the range of from about 20 to about 50; and p has an average value in the range of from about 10 to about 50.

The clay soil cleaning polymer is selected from the group consisting of ethoxylated oligamines, ethoxylated oligamine methyl quats, ethoxylated oligoamine benzyl quats, ethoxysulfated oligoamines methyl quats, propoxylated-ethoxysulfated oligoamine methyl quats, ethoxysulfated oligoamines benzyl quats, propoxylated-ethoxysulfated oligoamine benzyl quats, ethoxylated oligoetheramine methyl quats, ethoxylated oligoetheramine benzyl quats, ethoxysulfated oligoetheramines methyl quats, ethoxysulfated oligoetheramines benzyl quats, and mixtures thereof.

The soil suspending polymer is selected from the group consisting of i) alkoxylated polyethyleneimines having from about 5 to 24 ethoxylate groups per —NH group and from zero to about 12 propoxylate groups per —NH group; and ii) random graft copolymers having a hydrophilic backbone comprising monomers selected from the group consisting of unsaturated $C_{1-6}$ acids, ethers, alcohols, aldehydes, ketones or esters, sugar units, alkoxy units, maleic anhydride and saturated polyalcohols, and mixtures thereof; and hydrophobic side chains selected from the group comprising $C_{4-25}$ alkyl groups, polypropylene; polybutylene, a vinyl ester of a saturated monocarboxylic acid containing from 1 to 6 carbon atoms; a $C_{1-6}$ alkyl ester of acrylic or methacrylic acid; and iii) a mixture thereof.

DETAILED DESCRIPTION OF THE INVENTION

Laundry Detergents and Cleaning Compositions

The inventive laundry detergents and cleaning compositions of the present invention comprise a polymer system that comprising one or more amphiphilic alkoxylated grease cleaning polymers, and either a clay soil cleaning polymer; or a soil suspending polymer.

Amphiphilic Alkoxylated Grease Cleaning Polymers

The compositions of the present invention comprise one or more amphiphilic alkoxylated grease cleaning polymers. Amphiphilic alkoxylated grease cleaning polymers of the present invention refer to any alkoxylated polymers having balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure.

The core structure may comprise a polyalkylenimine structure comprising, in condensed form, repeating units of formulae (I), (II), (III) and (IV):

(I)

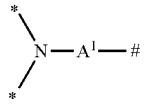

(II)

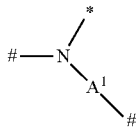

(III)

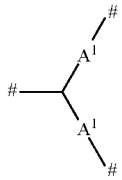

(IV)

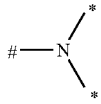

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol.

The core structure may alternatively comprise a polyalkanolamine structure of the condensation products of at least one compound selected from N-(hydroxyalkyl)amines of formulae (I.a) and/or (I.b), (I.a)

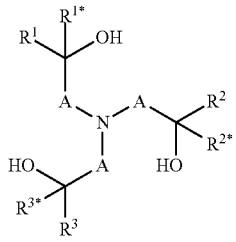

-continued (I.b)

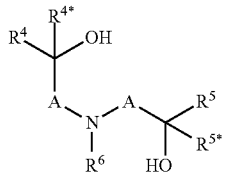

wherein A are independently selected from $C_1$-$C_6$-alkylene; $R^1$, $R^1$*, $R^2$, $R^2$*, $R^3$, $R^3$*, $R^4$, $R^4$*, $R^5$ and $R^5$* are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted.

The plurality of alkylenoxy groups attached to the core structure are independently selected from alkylenoxy units of the formula (V)

(V)

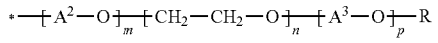

wherein * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50.

Specific embodiments of the amphiphilic alkoxylated grease cleaning polymers may be selected from alkoxylated polyalkylenimines having an inner polyethylene oxide block and an outer polypropylene oxide block, the degree of ethoxylation and the degree of propoxylation not going above or below specific limiting values. Specific embodiments of the alkoxylated polyalkylenimines according to the present invention have a minimum ratio of polyethylene blocks to polypropylene blocks (n/p) of about 0.6 and a maximum of about $1.5(x+2y+1)^{1/2}$. Alkoxykated polyalkyenimines having an n/p ratio of from about 0.8 to about $1.2(x+2y+1)^{1/2}$ have been found to have especially beneficial properties.

The alkoxylated polyalkylenimines according to the present invention have a backbone which consists of primary, secondary and tertiary amine nitrogen atoms which are attached to one another by alkylene radicals A and are randomly arranged. Primary amino moieties which start or terminate the main chain and the side chains of the polyalkylenimine backbone and whose remaining hydrogen atoms are subsequently replaced by alkylenoxy units are referred to as repeating units of formulae (I) or (IV), respectively. Secondary amino moieties whose remaining hydrogen atom is subsequently replaced by alkylenoxy units are referred to as repeating units of formula (II). Tertiary amino moieties which branch the main chain and the side chains are referred to as repeating units of formula (III).

Since cyclization can occur in the formation of the polyalkylenimine backbone, it is also possible for cyclic amino moieties to be present to a small extent in the backbone. Such polyalkylenimines containing cyclic amino moieties are of course alkoxylated in the same way as those consisting of the noncyclic primary and secondary amino moieties.

The polyalkylenimine backbone consisting of the nitrogen atoms and the groups $A^1$, has an average molecular weight Mw of from about 60 to about 10,000 g/mole, preferably from about 100 to about 8,000 g/mole and more preferably from about 500 to about 6,000 g/mole.

The sum (x+2y+1) corresponds to the total number of alkylenimine units present in one individual polyalkylenimine backbone and thus is directly related to the molecular weight of the polyalkylenimine backbone. The values given in the specification however relate to the number average of all polyalkylenimines present in the mixture. The sum (x+2y+2) corresponds to the total number amino groups present in one individual polyalkylenimine backbone.

The radicals $A^1$ connecting the amino nitrogen atoms may be identical or different, linear or branched $C_2$-$C_6$-alkylene radicals, such as 1,2-ethylene, 1,2-propylene, 1,2-butylene, 1,2-isobutylene, 1,2-pentanediyl, 1,2-hexanediyl or hexamethylen. A preferred branched alkylene is 1,2-propylene. Preferred linear alkylene are ethylene and hexamethylene. A more preferred alkylene is 1,2-ethylene.

The hydrogen atoms of the primary and secondary amino groups of the polyalkylenimine backbone are replaced by alkylenoxy units of the formula (V).

(V)

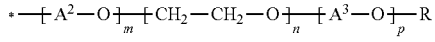

In this formula, the variables preferably have one of the meanings given below:

$A^2$ in each case is selected from 1,2-propylene, 1,2-butylene and 1,2-isobutylene; preferably $A^2$ is 1,2-propylene. $A^3$ is 1,2-propylene; R in each case is selected from hydrogen and $C_1$-$C_4$-alkyl, such as methyl, ethyl, n-propyl, isopropyl, n-butyl, isobutyl and tert-butyl; preferably R is hydrogen. The index m in each case has a value of 0 to about 2; preferably m is 0 or approximately 1; more preferably m is 0. The index n has an average value in the range of from about 20 to about 50, preferably in the range of from about 22 to about 40, and more preferably in the range of from about 24 to about 30. The index p has an average value in the range of from about 10 to about 50, preferably in the range of from about 11 to about 40, and more preferably in the range of from about 12 to about 30.

Preferably the alkylenoxy unit of formula (V) is a non-random sequence of alkoxylate blocks. By non-random sequence it is meant that the $[\text{-}A^2\text{-O—}]_m$ is added first (i.e., closest to the bond to the nitrogen atom of the repeating unit of formula (I), (II), or (III)), the $[\text{—}CH_2\text{—}CH_2\text{—O—}]_n$ is added second, and the $[\text{-}A^3\text{-O—}]_p$, is added third. This orientation provides the alkoxylated polyalkylenimine with an inner polyethylene oxide block and an outer polypropylene oxide block.

The substantial part of these alkylenoxy units of formula (V) is formed by the ethylenoxy units $\text{—}[CH_2\text{—}CH_2\text{—O}]_n\text{—}$ and the propylenoxy units $\text{—}[CH_2\text{—}CH_2(CH_3)\text{—O}]_p\text{—}$. The alkylenoxy units may additionally also have a small proportion of propylenoxy or butylenoxy units $\text{—}[A^2\text{-O}]_m\text{—}$, i.e. the polyalkylenimine backbone saturated with hydrogen atoms may be reacted initially with small amounts of up to about 2 mol, especially from about 0.5 to about 1.5 mol, in particular from about 0.8 to about 1.2 mol, of propylene oxide or butylene oxide per mole of NH— moieties present, i.e. incipiently alkoxylated.

This initial modification of the polyalkylenimine backbone allows, if necessary, the viscosity of the reaction mixture in the alkoxylation to be lowered. However, the modification generally does not influence the performance properties of the alkoxylated polyalkylenimine and therefore does not constitute a preferred measure.

The alkoxylated polyalkylenimines may be prepared in a known manner. Exemplary procedure are described in the U.S. Patent Application No. 61/002,720 filed on Nov. 9, 2007. Specific alkoxylated polyalkylenimine embodiments include, the 600 g/mol polyethylenimine core with 24 ethoxylate groups per —NH and 16 propoxylates per —NH, the 600 g/mol polyethylenimine core with 24 ethoxylate groups per —NH and 24 propoxylate groups per —NH, the diethylene tri amine with 24 ethoxylate groups per —NH and 24 propoxylates per —NH, and the hexamethylene diamine with 24 ethoxylate groups per —NH and 16 propoxylate groups per —NH described therein.

Specific embodiments of the amphiphilic alkoxylated grease cleaning polymers may be alternative be selected from alkoxylated polyalkanolamine polymers obtainable by a process comprising the steps of:

a) condensation of at least one compound selected from N-(hydroxyalkyl)amines of formulae (I.a) and/or (I.b), (I.a)

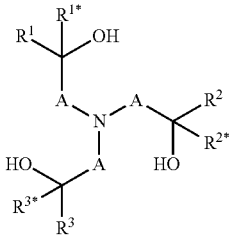

(I.b)

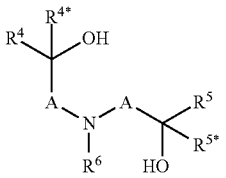

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted; and b) reacting at least a part of the remaining hydroxy groups and/or, if present, at least a part of the secondary amino groups of the polyether provided in step a) with at least one alkylene oxide.

Examples of N-(Hydroxyalkyl)amines (I.a) are N-tri-(2-hydroxyalkyl)-amines. N-tri-(2-hydroxyalkyl)-amines are obtainable by reacting ammonia with three equivalents of an alkylene oxides (ammonolysis). Preferred examples of such compounds (I.a) are triethanolamine, triisopropanolamine and tributan-2-olamine. Examples of N-(Hydroxyalkyl) amines (I.b) are N-di-(2-hydroxyalkyl)-amines which are obtainable by reacting a primary amine of formula $H_2N$—$R^6$, wherein $R^6$ has one of the meanings given above, with two equivalents of an alkylene oxide (aminolysis). Examples of such compounds (I.b) are e.g. N-methyldiethanolamine, N,N-bis-(2-hydroxypropyl)-N-methylamine, N,N-bis-(2-hydroxybutyl)-N-methylamine, N-isopropyldiethanolamine, N-n-butyldiethanolamine, N-sec-butyldiethanolamine, N-cyclohexyldiethanolamine, N-benzyldiethanolamine, N-4-tolyldiethanolamine, N,N-Bis-(2-hydroxyethyl)-anilin and the like.

Embodiments of alkoxylated polyalkanolamine polymers may be obtainable from compounds selected from N-(hydroxyalkyl)amines of formulae (I.a) and/or (I.b), wherein A is a methylene group, which is unsubstituted or carries one substituent selected from $C_{1-4}$-alkyl. Specific polymers are obtainable from compounds (I.a) and/or (I.b), wherein A is methylene or methylene carrying one methyl group. Particularly preferred are polymers obtainable from compounds (I.a) and/or (I.b), wherein A is unsubstituted methylene.

Other embodiments of the alkoxylated polyalkanolamine polymers are obtainable from compounds selected from N-(hydroxyalkyl)amines of formulae (I.a) and/or (I.b), wherein $R^1$, $R^{1*}$, $R^2$, $R^{2*}$, $R^3$, $R^{3*}$, $R^4$, $R^{4*}$, $R^5$ and $R^{5*}$ are independently of one another selected from hydrogen and $C_1$-$C_4$-alkyl, i.e. hydrogen, methyl, ethyl, n-propyl, isopropyl, n-butyl, sec-butyl and tert.-butyl. More preferably $R^1$, $R^{1*}$, $R^2$, $R^{2*}$, $R^3$, $R^{3*}$, $R^4$, $R^{4*}$, $R^5$ and $R^{5*}$ are independently of one another selected from hydrogen and methyl.

In one preferred embodiment the invention relates to polymers obtainable from N-(hydroxyalkyl)amines of formulae (I.a) and/or (I.b), wherein $R^{1*}$, $R^{2*}$, $R^{3*}$, $R^{4*}$ and $R^{5*}$ are hydrogen and $R^1$, $R^2$, $R^3$, $R^4$, and $R^5$ are independently of one another selected from hydrogen and $C_1$-$C_4$-alkyl. More preferably $R^{1*}$, $R^{2*}$, $R^{3*}$, $R^{4*}$ and $R^{5*}$ are hydrogen and $R^1$, $R^2$, $R^3$, $R^4$, and $R^5$ are independently of one another selected from hydrogen and methyl.

The polymer according to the invention is obtainable from N-(hydroxyalkyl)amines of formula (I.b) wherein $R^6$, if present, is preferably selected from hydrogen and $C_1$-$C_4$-alkyl.

The polymer according to the invention preferably is obtainable by a process wherein in step b) the at least one alkylene oxide is selected from epoxyethane, epoxypropane, 1,2-epoxybutane, 2,3-epoxybutane, 1,2-epoxy-2-methylpropane, 1,2-epoxypentane, 2,3-epoxypentane, 1,2-epoxy-2-methylbutane, 2,3-epoxy-2-methyl-butane, 1,2-epoxyhexane, 2,3-epoxyhexane, 3,4-epoxyhexane and 1,2-epoxyethylenebenzene. More preferably the at least one alkylene oxide is selected from epoxyethane and/or epoxypropane.

The polymer according to the invention preferably is obtainable by reacting 1 to 100 moles, preferably 2 to 80 moles of the at least one alkylene oxide with 1 mol of the remaining hydroxy groups and, if present, of the secondary amino groups of the polyether obtainable by condensation of the at least one compound of formulae (I.a) and/or (I.b).

The polymer according to the invention preferably has a number average molecular weight in the range of 500 to 100,000 g/mol, more preferably in the range of 1000 to 80,000 g/mol, and in particular in the range of from 2,000 to 50,000 g/mol. The polymer according to the invention preferably has a polydispersity (Mw/Mn) in the range of 1 to 10, and in particular in the range of 1 to 5.

In one particular embodiment the polymer according to the invention is obtainable by a process wherein in step a) less than 5% by weight, preferably less than 1% by weight and more preferably substantially no, i.e. less than 0.1% by weight, of co-condensable compounds different from compounds of formulae (I.a) and/or (I.b), are employed (i.e. co-condensed) based on the amount of the compounds of formulae (I.a) and/or (I.b).

The term "co-condensable compound" as used herein comprises compounds carrying at least one, preferably at least two acidic hydrogen atoms, such as diols or diamines. Examples for such co-condensable compounds are given below.

In another particular embodiment the polymer according to the invention is obtainable by a process wherein in step a) the at least one compound selected from N-(hydroxyalkyl) amines of formulae (I.a) and/or (I.b) is being co-condensed with at least one compound selected from polyols of formula $Y(OH)_n$, wherein n is an integer from 2 to 4 and Y denotes a bivalent, trivalent or tetravalent aliphatic, cycloaliphatic or aromatic radical having 2 to 10 carbon atoms.

Suitable polyols of formula $Y(OH)_n$ are aliphatic polyols, such as ethylene glycol, propylene glycol, butylene glycol, glycerine, tri(hydroxymethyl)ethane, tri(hydroxymethyl) propane or pentaerythrit, cycloaliphatic polyols, such as 1,4-dihydroxycyclohexane, arylaliphatic polyols, such as 1,4-bis-(hydroxymethyl)benzene, and the like.

If present, the polyols of formula $Y(OH)_n$ are generally co-condensed in an amount of 50% by weight or less based on the amount of the compounds of formulae (I.a) and/or (I.b), i.e. in an amount of from 0.1 to 50% by weight and more preferably in an amount of from 1 to 25% by weight.

In yet another particular embodiment of the invention the polymer is obtainable by a process wherein in step a) the at least one compound selected from N-(hydroxyalkyl)amines of formulae (I.a) and/or (I.b) is being co-condensed with at least one compound selected from polyamins of formula $Y'(NHR^y)_m$, wherein m is an integer from 2 to 4, Y' denotes a bivalent, trivalent or tetravalent aliphatic, cycloaliphatic or aromatic radical having 2 to 10 carbon atoms and $R^y$ has one of the meanings given for $R^6$ or two radicals $R^y$ together may form a $C_1$-$C_6$-alkylene group.

Suitable polyamines of formula $Y'(NHR^y)_m$ are ethylenediamin, N,N''-dimethylethylenediamin, N,N'-diethylethylenediamin, 1,2-diaminopropane, 1,3-diaminopropane, 1,2-diaminocyclohexane, 1,3-diaminocyclohexane, 1,4-diaminocyclohexane, piperazin and the like.

If present, the polyamines of formula $Y'(NHR^y)_m$ are generally co-condensed in an amount of 50% by weight or less based on the amount of the compounds of formulae (I.a) and/or (I.b), i.e. in an amount of from 0.1 to 50% by weight and more preferably in an amount of from 1 to 25% by weight.

The alkoxylated polyalkanolamines may be prepared in any known manner. Exemplary procedure are described in the U.S. Patent Application No. 61/002,720 filed on Nov. 9, 2007.

The amphiphilic alkoxylated grease cleaning polymers are present in the detergent and cleaning compositions of the present invention at levels ranging from about 0.05% to 10% by weight of the composition. Embodiments of the compositions may comprise from about 0.1% to about 5% by weight. More specifically, the embodiments may comprise from about 0.25 to about 2.5% of the grease cleaning polymer.

Clay Soil Cleaning Polymers

The polymer system of the detergent and cleaning compositions of the present inventions may comprise a clay soil cleaning polymer. As discussed in U.S. Pat. No. 4,661,288, a clay soil cleaning polymer with the ability to remove clay particulate soils from fabrics during laundering. Without being limited by theory, clay cleaning compounds must have the ability to adsorb onto the negatively charged layers of the clay particle and the ability to push apart the negatively charged layers of the clay to the clay particle loses its cohesive force and can be removed in the wash water.

Specific classes of the clay soil cleaning polymers which may be used in the present inventions may include, without limitation, ethoxylated oligamines, ethoxylated oligamine methyl quats, ethoxylated oligoamine benzyl quats, ethoxysulfated oligoamines methyl quats, propoxylated-ethoxysulfated oligoamine methyl quats, ethoxysulfated oligoamines benzyl quats, propoxylated-ethoxysulfated oligoamine benzyl quats, ethoxylated oligoetheramine methyl quats, ethoxylated oligoetheramine benzyl quats, ethoxysulfated oligoetheramines methyl quats, ethoxysulfated oligoetheramines benzyl quats, and mixtures thereof.

Specific embodiments of the clay soil cleaning polymers may be selected from the group consisting of ethoxylated tetraethylene pentamine; ethoxylated hexamethylene diamine dimethyl quat; ethoxysulfated hexamethylene diamine dimethyl quat; ethoxysulfated hexamethyl tri(amine methyl quat); ethoxypropoxysulfated hexamethylene diamin dimethyl quat; ethoxy hexamethylene poly(amine benzyl quat); ethoxysulfated hexamethylene poly(amine benzyl quat); bis(hexamethylene)triamine ethoxylated about 30 times per —NH group and quaternized about 90%; ethoxylated 4,9-dioxa-1,12-dodecanediamine dimethyl quat tetrasulfate; propoxylated-ethoxylated benzyl-quaternized transsulfated bis(hexamethylene)triamine; 50% sulfonated, propoxylated, ethoxylated methyl quat of hexamethylene diamine, and mixtures thereof. These polymers, and the processes for making them, have been disclosed in U.S. Pat. No. 4,551,506, U.S. Pat. No. 4,622,378, U.S. Pat. No. 4,661,288, U.S. Pat. No. 4,897,898, EP 0137615B, U.S. Pat. No. 6,525,012, U.S. Pat. No. 6,846,791, EP 1228035, EP 1228179.

The clay soil cleaning polymers are optional in the polymer system of the detergent and cleaning compositions of the present invention. However, when used they are used at levels ranging from about 0.05% to 10% by weight of the composition. Embodiments of the compositions may comprise from about 0.1% to about 5% by weight. More specifically, the embodiments may comprise from about 0.25 to about 2.5% of the clay cleaning polymer.

Other useful cleaning polymers are polyacrylates, which preferably have a molecular mass in the range from about 2000 to about 20,000 g/mol. Owing to their superior solubility, preference in this group may be given in turn to the short-chain polyacrylates which have molar masses in the range from 2000 to 10,000 g/mol and more preferably in the range from 3000 to 5000 g/mol. Useful polymers may further include substances which partly or wholly consist of units of vinyl alcohol or its derivatives.

Useful polymeric polycarboxylates further include copolymeric polycarboxylates, especially those of acrylic acid with methacrylic acid and of acrylic acid or methacrylic acid with maleic acid. Of particular usefulness are copolymers of acrylic acid with maleic acid which comprise from about 50% to about 90% by weight of acrylic acid and from about 10% to about 50% by weight of maleic acid. Their relative molecular mass based on free acids is generally in the range from 2000 to 70,000 g/mol, preferably in the range from 20,000 to 50,000 g/mol and especially in the range from 30,000 to 40,000 g/mol.

To improve solubility in water, polymers may further comprise allylsulfonic acids, such as allyloxybenzenesulfonic acid and methallylsulfonic acid, or as a monomer. Preference is also given in particular to biodegradable polymers composed of more than two different monomer units, for example those which comprise salts of acrylic acid and of maleic acid and also vinyl alcohol or vinyl alcohol derivatives as monomers or comprise salts of acrylic acid and of 2-alkylallylsulfonic acid and also sugar derivatives as monomers. Preferred copolymers further include those which as monomers preferably comprise acrolein and acrylic acid/acrylic acid salts or acrolein and vinyl acetate.

Another useful class of polycarboxylate copolymers are copolymers of acrylic acid or methacrylic acid and hydrophobic ethylenically unsaturated monomers containing alky, aryl, or alkoxy groups or combinations thereof.

Preferred polymers further include polymeric amino dicarboxylic acids, their salts or their precursor substances. Particular preference is given to polyaspartic acids or salts and derivatives thereof, of which it is known that they have a bleach-stabilizing effect as well as cobuilder properties.

Soil Suspending Polymers

The polymer system of the detergent and cleaning compositions of the present invention may comprise a soil suspending polymer. A soil suspending polymer is any polymer suspends removed soil, thereby preventing the redeposition of the soil particle onto the surface.

tion wherein the terminal alkoxy moiety is capped with hydrogen, a $C_1$-$C_4$ alkyl or mixtures thereof; or (3) a combination thereof.

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. In some embodiments, the polyalkoxylene chain is selected from ethoxy moieties and ethoxy/propoxy block moieties. The polyalkoxylene chain may be ethoxy moieties in an average degree of from about 5 to about 15 or the polyalkoxylene chain may be ethoxy/propoxy block moieties having an average degree of ethoxylation from about 5 to about 15 and an average degree of propoxylation from about 1 to about 16.

One specific alkoxylated polyethyleneimine has the general structure of formula (I):

formula (I)

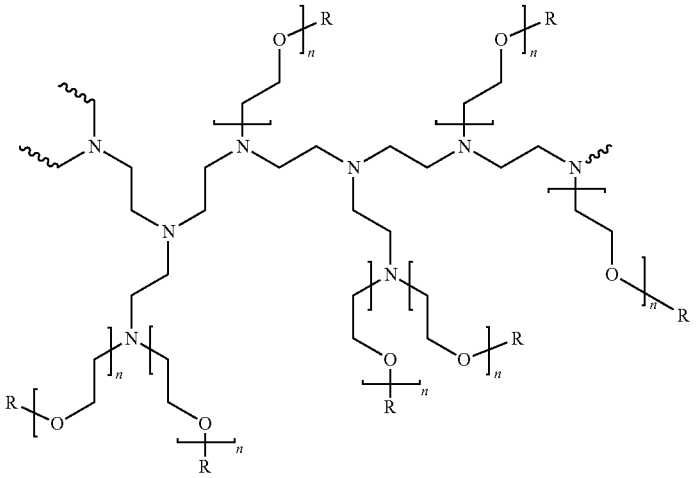

Specific soil suspending polymers which may be used in the present invention may include alkoxylated polyethyleneimines having a polyethyleneimine backbone having a molecular weight from about 300 to about 10000 weight average molecular weight, preferably from about 400 to about 7500 weight average molecular weight, preferably about 500 to about 1900 weight average molecular weight and preferably from about 3000 to 6000 weight average molecular weight. The polyethyleneimine backbone is modified by either: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modificawherein the polyethyleneimine backbone has a weight average molecular weight of 600, n of formula (I) has an average of 20 and R of formula (I) is selected from hydrogen, a $C_1$-$C_4$ alkyl and mixtures thereof.

These alkoxylated polyethylenimines, and the processes for making them, have been disclosed in U.S. Pat. No. 3,489,686, U.S. Pat. No. 5,565,145, U.S. Pat. No. 6,004,922, and WO 2006/108857.

The soil suspending polyer may alternatively be a amphiphilic random graft copolymers having a hydrophilic backbone comprising monomers selected from the group consisting of unsaturated $C_{1-6}$ acids, ethers, alcohols, aldehydes, ketones or esters, sugar units, alkoxy units, maleic anhydride and saturated polyalcohols, and mixtures thereof; and hydrophobic side chains selected from the group comprising $C_{4-25}$ alkyl groups, polypropylene; polybutylene, a vinyl ester of a saturated monocarboxylic acid containing from 1 to 6 carbon atoms; a $C_{1-6}$ alkyl ester of acrylic or methacrylic acid; or a mixture thereof. One specific useful embodiment of the soil suspending polymers is a random graft copolymer having a hydrophilic backbone comprising polyethylene glycol of molecular weight from 4,000 to 15,000, and from 50% to 65% by weight hydrophobic side chains formed by polymerising at least one monomer selected from a vinyl ester of a saturated monocarboxylic acid containing from 1 to 6 carbon atoms and/or a $C_{1-6}$ alkyl ester of acrylic or methacrylic acid. Another embodiment of the soil suspending polymer is a random graft copolymer having a hydrophilic backbone comprising polyethylene glycol of molecular weight from 4,000 to 15,000, and from 50% to 65% by weight hydrophobic side chains formed by polymerising at least one monomer selected from vinyl acetate, vinyl propionate and/or butyl acrylate. An example of such a polymer would be a water-soluble polyalkylene oxide graft base having side chains formed by polymerization of a vinyl ester component, said polymer having an average of ≦1 graft site per 50 alkylene oxide units and mean molar masses $M_w$ of from 3000 to 100,000 g/mol. This example polymer could have a polydispersity, $M_w/M_n$, of less than or equal to about 3.

The amphiphilic graft polymers of use in the present invention as well as methods of making them are described in detail in European Patent Application Number 06114756, EP A-219048, EP A-358474, and WO 2006/130442. They may be present in the detergent or cleaning compositions at weight percentages of from about 0.05% to about 10%, from about 0.1% to about 5%, from about 0.2% to about 3%, or from about 0.3% to about 2%.

The amphiphilic graft polymers are based on water-soluble polyalkylene oxides as a graft base and side chains formed by polymerization of a vinyl ester component. These polymers having an average of ≦one graft site per 50 alkylene oxide units and mean molar masses ($M_w$) of from about 3000 to about 100,000.

One method of preparing the amphiphilic graft polymers comprises the steps of: polymerizing a vinyl ester component (B) composed of vinyl acetate and/or vinyl propionate (B1) and, if desired, a further ethylenically unsaturated monomer (B2), in the presence of a water-soluble polyalkylene oxide (A), a free radical-forming initiator (C) and, if desired, up to 40% by weight, based on the sum of components (A), (B) and (C), of an organic solvent (D), at a mean polymerization temperature at which the initiator (C) has a decomposition half-life of from 40 to 500 min, in such a way that the fraction of unconverted graft monomer (B) and initiator (C) in the reaction mixture is constantly kept in a quantitative deficiency relative to the polyalkylene oxide (A).

The graft polymers are characterized by their low degree of branching (degree of grafting); they have, on average, based on the reaction mixture obtained, not more than 1 graft site, not more than 0.6 graft site, not more than 0.5 graft site or not more than 0.4 graft site per 50 alkylene oxide units. They comprise, on average, based on the reaction mixture obtained, at least about 0.05, or at least about 0.1 graft site per 50 alkylene oxide units. The degree of branching can be determined, for example, by means of $^{13}C$ NMR spectroscopy from the integrals of the signals of the graft sites and the —$CH_2$— groups of the polyalkylene oxide.

In accordance with their low degree of branching, the molar ratio of grafted to ungrafted alkylene oxide units in the inventive graft polymers is from about 0.002 to about 0.05, from about 0.002 to about 0.035, from about 0.003 to about 0.025, or from about 0.004 to about 0.02.

In some embodiment, the inventive graft polymers feature a narrow molar mass distribution and hence a polydispersity $M_w/M_n$ of generally less than or equal to about 3, less than or equal to about 2.5, or less than or equal to about 2.3. In some embodiments, their polydispersity $M_w/M_n$ is in the range of from about 1.5 to about 2.2. The polydispersity of the graft polymers can be determined, for example, by gel permeation chromatography using narrow-distribution polymethyl methacrylates as the standard. The mean weight average molecular weight $M_w$, of the inventive graft polymers is from about 3000 to about 100,000, from about 6000 to about 45,000, or from about 8000 to about 30,000.

Other embodiments of the inventive graft polymers also have only a low content of ungrafted polyvinyl ester (B). In general, they comprise less than or equal to about 10% by weight, less than or equal to about 7.5% by weight, or less than or equal to about 5% by weight of ungrafted polyvinyl ester (B).

Due to the low content of ungrafted polyvinyl ester and the balanced ratio of components (A) and (B), the inventive graft polymers may be soluble in water or in water/alcohol mixtures (for example an about 25% by weight solution of diethylene glycol monobutyl ether in water). They can have pronounced, low cloud points which, for the graft polymers that are soluble in water at up to about 50° C., less than or equal to about 95° C., less than or equal to about 85° C., or less than or equal to about 75° C., and, for the other graft polymers in about 25% by weight diethylene glycol monobutyl ether, less than or equal to about 90° C., or from about 45° C. to about 85° C.

In some embodiments, the inventive amphiphilic graft polymers have:

(A) from about 20 to about 70% by weight of a water-soluble polyalkylene oxide as a graft base and (B) side chains formed by free-radical polymerization of from about 30 to about 80% by weight of a vinyl ester component composed of:

(B1) from about 70 to about 100% by weight of vinyl acetate and/or vinyl propionate and (B2) from 0 to about 30% by weight of a further ethylenically unsaturated monomer in the presence of (A).

In some embodiments, they comprise from about 25 to about 60% by weight of the graft base (A) and from about 40 to about 75% by weight of the polyvinyl ester component (B).

Water-soluble polyalkylene oxides suitable for forming the graft base (A) are in principle all polymers based on $C_2$-$C_4$-alkylene oxides which comprise at least about 50% by weight, at least about 60% by weight, or at least about 75% by weight of ethylene oxide in copolymerized form.

The polyalkylene oxides (A) may have a low polydispersity $M_w/M_n$. In some embodiments, their polydispersity is less than or equal to about 1.5.

The polyalkylene oxides (A) may be the corresponding polyalkylene glycols in free form, i.e. with OH end groups, but they may also be capped at one or both end groups. Suitable end groups are, for example, $C_1$-$C_{25}$-alkyl, phenyl and $C_1$-$C_{14}$-alkylphenyl groups.

Non-limiting examples of particularly suitable polyalkylene oxides (A) include:

(A1) polyethylene glycols which may be capped at one or both end groups, especially by $C_1$-$C_{25}$-alkyl groups, which in some embodiments are not etherified, and have mean molar masses $M_n$ of from about 1500 to about 20,000, or from about 2500 to about 15,000;

(A2) copolymers of ethylene oxide and propylene oxide and/or butylene oxide with an ethylene oxide content of at least about 50% by weight, which may likewise be capped at one or both end groups, for example by $C_1$-$C_{25}$-alkyl groups, but are not etherified, and have mean molar masses $M_n$ of from about 1500 to about 20,000, or from about 2500 to about 15,000;

(A3) chain-extended products having mean molar masses of from about 2500 to about 20,000, which are obtainable by reacting polyethylene glycols (A1) having mean molar masses $M_n$ of from about 200 to about 5000 or copolymers (A2) having mean molar masses $M_n$ of from about 200 to about 5000 with $C_2$-$C_{12}$-dicarboxylic acids or -dicarboxylic esters or $C_6$-$C_{18}$-diisocyanates.

In some embodiments, the graft bases (A) are the polyethylene glycols (A1). The side chains of the inventive graft polymers are formed by polymerization of a vinyl ester component (B) in the presence of the graft base (A). The vinyl ester component (B) may comprise (B1) vinyl acetate or vinyl propionate or of mixtures of vinyl acetate and vinyl propionate, in some embodiments, preference being given to vinyl acetate as the vinyl ester component (B). However, the side chains of the graft polymer can also be formed by copolymerizing vinyl acetate and/or vinyl propionate (B1) and a further ethylenically unsaturated monomer (B2). The fraction of monomer (B2) in the vinyl ester component (B) may be up to about 30% by weight, which corresponds to a content in the graft polymer of (B2) of about 24% by weight.

Suitable comonomers (B2) are, for example, monoethylenically unsaturated carboxylic acids and dicarboxylic acids and their derivatives, such as esters, amides and anhydrides, and styrene. It is of course also possible to use mixtures of different comonomers.

Specific non-limiting examples include: (meth)acrylic acid, $C_1$-$C_{12}$-alkyl and hydroxy-$C_2$-$C_{12}$-alkyl esters of (meth) acrylic acid, (meth)acrylamide, N—$C_1$-$C_{12}$-alkyl(meth) acrylamide, N,N-di($C_1$-$C_6$-alkyl)(meth)acrylamide, maleic acid, maleic anhydride and mono($C_1$-$C_{12}$-alkyl)esters of maleic acid.

In some embodiments, the monomers (B2) are the $C_1$-$C_8$-alkyl esters of (meth)acrylic acid and hydroxyethyl acrylate. In some embodiments, preference may be given to the $C_1$-$C_4$-alkyl esters of (meth)acrylic acid. In some embodiments, preference may be given to monomers (B2) that are methyl acrylate, ethyl acrylate and in particular n-butyl acrylate. When the inventive graft polymers comprise the monomers (B2) as a constituent of the vinyl ester component (B), the content of graft polymers in (B2) may be from about 0.5 to about 20% by weight, from about 1 to 15% by weight, or from about 2 to about 10% by weight.

The soil suspending polymer may also be selected from quaternized and sulfated derivatives of the alkoxylated polyalkanolamine polymers that act as grease cleaning polymers. For clarity, the un-quaternized, un-sulfated alkoxylated polyalkanolamine act as grease cleaning polymers herein, however the quaternized, sulfated derivatives are poorer grease cleaners, but are good soil suspending polymers.

The quaternized, sulfated alkoylated polyalkanolamines are obtainable by a process comprising the steps of:

a) condensation of at least one compound selected from N-(hydroxyalkyl)amines of formulae (I.a) and/or (I.b), (I.a)

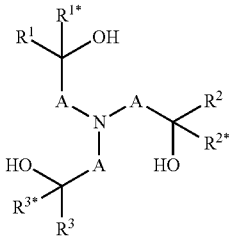

-continued (I.b)

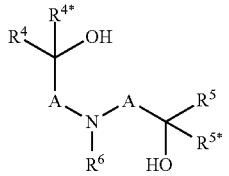

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted; and b) reacting at least a part of the remaining hydroxy groups and/or, if present, at least a part of the secondary amino groups of the polyether provided in step a) with at least one alkylene oxide and or derivatives of said alkoxylated polyalkanolamine polymers obtainable by the additional step of c) quarternization, protonation, sulphation and/or phosphation of said polymer.

The derivatives obtainable by step c) quarternization, protonation, sulphation and/or phosphation of the polymers are obtained by taking the polymer obtained in step b) and subjecting it to derivatization or thus obtained derivatives can be subjected to a further derivatisation such as quarternization, protonation, sulphation and/or phosphation.

Derivatives of the alkoxylated polyalkanolaimine polymers containing quaternary ammonium groups, i.e. charged cationic groups, can be produced from the amine nitrogen atoms by quaternization with alkylating agents. These include $C_1$-$C_4$-alkyl halides or sulphates, such as ethyl chloride, ethyl bromide, methyl chloride, methyl bromide, dimethyl sulphate and diethyl sulfate. A preferred quaternizing agent is dimethyl sulfate.

Derivatives of the polymers containing charged cationic groups (different from quaternary ammonium groups) can also be produced from the amine nitrogen atoms by protonation with acids. Suitable acids are, for example, carboxylic acids, such as lactic acid, or mineral acids, such as phosphoric acid, sulfuric acid and hydrochloric acid.

The sulphation of the polymers can be effected by a reaction with sulphuric acid or with a sulphuric acid derivative. Thus, acidic alkyl ether sulphates are obtained. Suitable sulphation agents are e.g. sulphuric acid (preferably 75 to 100% strength, more preferably 85 to 98% strength), oleum, $SO_3$, chlorosulphuric acid, sulphuryl chloride, amidosulphuric acid and the like. If sulphuryl chloride is being used as sulphation agent the remaining chlorine is being replaced by hydrolysis after sulphation.

The sulphation agent is frequently used in equimolar or amounts or in excess, e.g. 1 to 1.5 moles per mol of OH—group present in the polymer according to the invention. But, the sulphation agent can also be used in sub-equimolar amounts. The sulphation can be effected in the presence of a solvent or entrainer. A suitable solvent or entrainer is e.g. toluene. After sulphation the reaction mixture is generally neutralized and worked up in a conventional manner.

The phosphation of the polymers can be effected by a reaction with phosphoric acid or with a phosphoric acid derivative. Thus, acidic alkyle ether phosphates are obtained. Phosphation of the polymers is generally carried out in analogous way to the sulphation described before. Suitable phosphation agents are e.g. phosphoric acid, polyphosphoric acid, phosphorous pentoxide, $POCl_3$ and the like. If $POCl_3$ is being used as sulphation agent the remaining chlorine is being replaced by hydrolysis after sulphation.

The soil suspending polymer may also be selected from zwitterionic and ethoxylated polyamidoamine of WO2005/093030. The is modified polyaminoamide comprised formula (I)

(I)

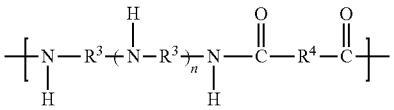

wherein n of formula (I) is an integer from 1 to 500; $R^3$ formula (I) is selected from an $C_2$-$C_8$ alkanediyl, preferably 1,2-ethanediyl or 1,3-propane diol; $R^4$ formula (I) is selected from a chemical bond, $C_1$-$C_{20}$-alkanediyl, $C_1$-$C_{20}$-alkanediyl comprising 1 to 6 heteroatoms selected from the group consisting of oxygen, sulfur, and nitrogen, $C_1$-$C_{20}$-alkanediyl comprising 1 to 6 heteroatoms selected from the group consisting of oxygen, sulfur, and nitrogen further comprising one or more hydroxyl groups, a substituted or unsubstituted divalent aromatic radical, and mixtures thereof; wherein formula (I) comprises secondary amino groups of the polymer backbone, the secondary amino groups comprise amino hydrogens, the amino hydrogens are selectively substituted in the modified polyaminoamide such that the modified polyaminoamide comprises partial quaternization of the secondary amino groups by selectively substituting at least one amino hydrogen with at least one alkoxy moiety of formula (II):

$$—(CH_2—CR^1R^2—O—)_pA \quad (II)$$

wherein A of formula (II) is selected from a hydrogen or an acidic group, the acidic group being selected from $—B^1—PO(OH)_2$, $—B^1—S(O)_2OH$ and $—B^2—COOH$; such that $B^1$ of formula (II) is a single bond or $C_1$-$C_6$-alkanediyl; and $B^2$ of formula (II) is $C_1$-$C_6$-alkanediyl; $R^1$ of formula (II) is independently selected from hydrogen, $C_1$-$C_{12}$-alkyl, $C_2$-$C_8$-alkenyl, $C_6$-$C_{16}$-aryl or $C_6$-$C_{16}$-aryl-$C_1$-$C_4$-alkyl; $R^2$ of formula (II) is independently selected from hydrogen or methyl; and p of formula (II) is an integer comprising a number average of at least 10; with the remainder of the amino hydrogens of the secondary amino groups being selected from the group comprising electron pairs, hydrogen, $C_1$-$C_6$-alkyl, $C_6$-$C_{16}$-aryl-$C_1$-$C_4$-alkyl and formula (III) Alk-O-A, wherein A of formula (III) is hydrogen or an acidic group, the acidic group being selected from $—B^1—PO(OH)_2$, $—B^1—S(O)_2OH$ and $—B^2—COOH$; such that $B^1$ of formula (III) is selected from a single bond or a $C_1$-$C_6$-alkanediyl; and $B^2$ of formula (III) is selected from a $C_1$-$C_6$-alkanediyl, and Alk of formula (III) is $C_2$-$C_6$-alkane-1,2-diol; the secondary amino groups of formula (I) are further selected to comprise at least one alkylating moiety of formula (IV):

$$—RX \quad (IV)$$

wherein R of formula (IV) is selected from the group consisting of: $C_1$-$C_6$-alkyl, $C_6$-$C_{16}$-aryl-$C_1$-$C_4$-alkyl and formula (III) Alk-O-A, formula (II) $—(CH_2—CR^1R^2—O—)_pA$; and X of formula (IV) is a leaving group selected from halogen, an alkyl-halogen, a sulphate, an alkyl sulphonate, an aryl sulphonate, an alkyl sulphate, and mixtures thereof.

The modified polyaminoamide can further comprises aliphatic, aromatic or cycloaliphatic diamines to give the general formula (VII):

(VI)

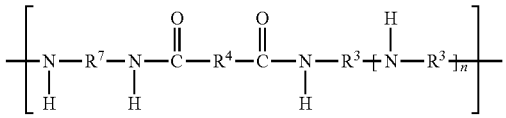

wherein $R^3$, $R^4$, and n of formula (VI) are the same as formula (I); $R^7$ of formula (VI) is a bivalent organic radical carrying from 1 to 20 carbon atoms, $C_1$-$C_{20}$-alkanediyl comprising 1 to 6 heteroatoms selected from the group consisting of oxygen, sulfur, and nitrogen, $C_1$-$C_{20}$-alkanediyl, $C_1$-$C_{20}$-alkanediyl comprising 1 to 6 heteroatoms selected from the group consisting of oxygen, sulfur, and nitrogen further comprising one or more hydroxyl groups, a substituted or unsubstituted divalent aromatic radical, and mixtures thereof.

The modified polyaminoamide can further comprise an esterification moiety for the alkoxy moiety, the alkylating moiety, and mixtures thereof, provided a hydroxyl group is present in the alkoxy moiety and the alkylating moiety. The esterification moiety may be selected from chlorosulfonic acid, sulfur trioxide, amidosulfonic acid, polyphosphate, phosphoryl chloride, phosphorpentoxide, and mixtures thereof.

The polyaminoamide can comprise primary amino groups of the polymer backbone, preferably the primary amino groups comprise amino hydrogens, the amino hydrogens are modified by comprising at least one alkoxy moiety of formula (II), with the remainder of the amino hydrogens of the secondary amino groups being further modified from the group consisting of electron pairs, hydrogen, $C_1$-$C_6$-alkyl, $C_6$-$C_{16}$-aryl-$C_1$-$C_4$-alkyl and formula (III) Alk-O-A, and the primary amino groups are further modified by comprising at least one alkylating moiety of formula (II). Such modified polyaminoamide can further comprise an esterification moiety for the alkoxy moiety, the alkylating moiety, and mixtures thereof when a hydroxyl group is present in the alkoxy moiety and the alkylating moiety. The etherifying moieties can be selected from the formula (XV) $L-B^3-A'$, wherein A' of formula (XV) is selected from —COOH, $—SO_3H$, and $—PO(OH)_2$, $B^3$ of formula (XV) is selected from $C_1$-$C_6$-alkandiyl; and L of formula (XV) is a leaving group that can be replaced by nucleophiles.

In one embodiment, the detergent composition comprises a modified polyaminoamide of formula (LX):

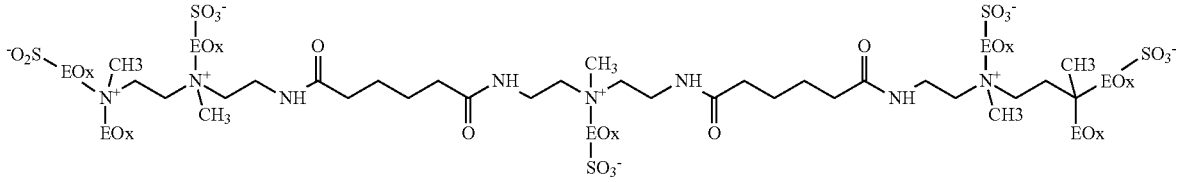

wherein x of formula (IX) is from 10 to 200, preferably from about 15 to about 150, most preferably from about 21 to about 100. Most preferably the number average of x of formula (IX) ranges from 15 to 70, especially 21 to 50. EO in formula (IX) represents ethoxy moieties.

In another embodiment, the detergent composition comprises a modified polyaminoamide of formula (X):

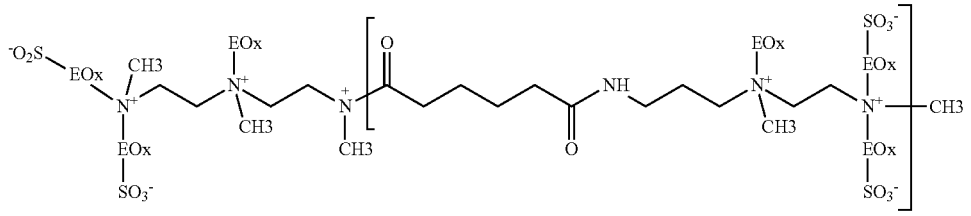

wherein x of formula (X) is from 10 to 200, from about 15 to about 150, or from about 21 to about 100. The number average of x of formula (X) ranges from 15 to 70, especially 21 to 50. EO in formula (X) represents ethoxy moieties. The ratio of dicarboxylic acid:polyalkylenepolyamines in formula (X) is 4:5 and 35:36.

Other soil suspending contemplated for use as soil suspending polymers include the class of polyacrylate polymers, such as the copolymers of (meth)acrylic and (meth)acrylic-ethylene oxide condensate disclosed in U.S. Pat. No. 3,719,647, and carboxymethyl cellulose derivatives disclosed in U.S. Pat. Nos. 3,597,416 and 3,523,088.

The soil suspending polymers are optional in the polymer system of the detergent and cleaning compositions of the present invention. When used they are incorporated at levels ranging from about 0.05% to 10% by weight of the composition. Embodiments of the compositions may comprise from about 0.1% to about 5% by weight. More specifically, the embodiments may comprise from about 0.25 to about 2.5% of the soil suspending polymer.

Multi-Polymer System

The laundry detergent and cleaning compositions of the present invention comprise system of polymers comprising at least one of the amphiphilic grease cleaning polymers and either at least one clay soil cleaning polymer or at least one soil suspending polymers.

Detergent and Cleaning Composition Ingredients

In addition to the polymer system described above, the laundry detergents and cleaning compositions generally comprise surfactants and, if appropriate, other polymers as washing substances and builders, and further customary ingredients, for example cobuilders, complexing agents, bleaches, standardizers, graying inhibitors, dye transfer inhibitors, enzymes and perfumes.

The multi-polymer system of the present invention may be utilized in laundry detergents or cleaning compositions comprising a surfactant system comprising $C_{10}$-$C_{16}$ alkyl benzene sulfonates (LAS) and one or more co-surfactants selected from nonionic, cationic, anionic or mixtures thereof. Alternately, the multi-polymer system of the present invention may be utilized in laundry detergents or cleaning compositions comprising surfactant systems comprising any anionic surfactant or mixture thereof with nonionic surfactants and/or fatty acids, optionally complemented by zwitterionic or so-called semi-polar surfactants such as the C12-C16 alkyldimethylamine N-oxides can also be used. In other embodiments, the surfactant used can be exclusively anionic or exclusively nonionic. Suitable surfactant levels are from about 0.5% to about 80% by weight of the detergent composition, more typically from about 5% to about 60% by weight.

A preferred class of anionic surfactants are the sodium, potassium and alkanolammonium salts of the $C_{10}$-$C_{16}$ alkylbenzenesulfonates which can be prepared by sulfonation (using $SO_2$ or $SO_3$) of alkylbenzenes followed by neutralization. Suitable alkylbenzene feedstocks can be made from olefins, paraffins or mixtures thereof using any suitable alkylation scheme, including sulfuric and HF-based processes. Any suitable catalyst may be used for the alkylation, including solid acid catalysts such as DETAL™ solid acid catalyst available commercially from UOP, a Honeywell company. Such solid acid catalysts include DETAL™ DA-114 catalyst and other solid acid catalysts described in patent applications to UOP, Petresa, Huntsman and others. It should be understood and appreciated that, by varying the precise alkylation catalyst, it is possible to widely vary the position of covalent attachment of benzene to an aliphatic hydrocarbon chain. Accordingly alkylbenzene sulfonates useful herein can vary widely in 2-phenyl isomer and/or internal isomer content.

The selection of co-surfactant may be dependent upon the desired benefit. In one embodiment, the co-surfactant is selected as a nonionic surfactant, preferably $C_{12}$-$C_{18}$ alkyl ethoxylates. In another embodiment, the co-surfactant is selected as an anionic surfactant, preferably $C_{10}$-$C_{18}$ alkyl alkoxy sulfates ($AE_xS$) wherein x is from 1-30. In another embodiment the co-surfactant is selected as a cationic surfactant, preferably dimethyl hydroxyethyl lauryl ammonium chloride. If the surfactant system comprises $C_{10}$-$C_{15}$ alkyl benzene sulfonates (LAS), the LAS is used at levels ranging from about 9% to about 25%, or from about 13% to about 25%, or from about 15% to about 23% by weight of the composition.

In one embodiment, the surfactant system may comprise from 0% to about 7%, or from about 0.1% to about 5%, or from about 1% to about 4% by weight of the composition of a co-surfactant selected from a nonionic co-surfactant, cationic co-surfactant, anionic co-surfactant and any mixture thereof.

Non-limiting examples of nonionic co-surfactants include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. No. 6,153,577, U.S. Pat. No. 6,020,303 and U.S. Pat. No. 6,093,856; alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408. Also useful herein as nonionic surfactants or co-surfactants are alkoxylated ester surfactants such as those having the formula $R^1C(O)O(R^{20})R^3$ wherein $R^1$ is selected from linear and branched $C_6$-$C_{22}$ alkyl or alkylene moieties; $R^2$ is selected from $C_2H_4$ and $C_3H_6$ moieties and $R^3$ is selected from H, $CH_3$, $C_2H_5$ and $C_3H_7$ moieties; and n has a value between 1 and 20. Such alkoxylated ester surfactants include the fatty methyl ester ethoxylates (MEE) and are well-known in the art; see for example U.S. Pat. No. 6,071,873; U.S. Pat. No. 6,319,887; U.S. Pat. No. 6,384,009; U.S. Pat. No. 5,753,606; WO 01/10391, WO 96/23049.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. No. 4,681,704, and U.S. Pat. No. 4,133,779.

Non-limiting examples of cationic co-surfactants include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

Nonlimiting examples of anionic co-surfactants useful herein include: $C_{10}$-$C_{20}$ primary, branched chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein x is from 1-30; $C_{10}$-$C_{18}$ alkyl alkoxy carboxylates comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242 and WO 99/05244; methyl ester sulfonate (MES); and alpha-olefin sulfonate (AOS). Anionic surfactants herein may be used in the form of their sodium, potassium or alkanolammonium salts.

The present invention may also relates to compositions comprising the inventive multi-polymer system and a surfactant system comprising $C_8$-$C_{18}$ linear alkyl sulphonate surfactant and a co-surfactant. The compositions can be in any form, namely, in the form of a liquid; a solid such as a powder, granules, agglomerate, paste, tablet, pouches, bar, gel; an emulsion; types delivered in dual-compartment containers; a spray or foam detergent; premoistened wipes (i.e., the cleaning composition in combination with a nonwoven material such as that discussed in U.S. Pat. No. 6,121,165, Mackey, et al.); dry wipes (i.e., the cleaning composition in combination with a nonwoven materials, such as that discussed in U.S. Pat. No. 5,980,931, Fowler, et al.) activated with water by a consumer; and other homogeneous or multiphase consumer cleaning product forms. The composition may be in the form of a tablet or pouch, including multi-compartment pouches.

In one embodiment, the cleaning composition of the present invention is a liquid or solid laundry detergent composition. In another embodiment, the cleaning composition of the present invention is a hard surface cleaning composition, preferably wherein the hard surface cleaning composition impregnates a nonwoven substrate. As used herein "impregnate" means that the hard surface cleaning composition is placed in contact with a nonwoven substrate such that at least a portion of the nonwoven substrate is penetrated by the hard surface cleaning composition, preferably the hard surface cleaning composition saturates the nonwoven substrate. The cleaning composition may also be utilized in car care compositions, for cleaning various surfaces such as hard wood, tile, ceramic, plastic, leather, metal, glass. This cleaning composition could be also designed to be used in a personal care and pet care compositions such as shampoo composition, body wash, liquid or solid soap and other cleaning composition in which surfactant comes into contact with free hardness and in all compositions that require hardness tolerant surfactant system, such as oil drilling compositions.

In another embodiment the cleaning composition is a dish cleaning composition, such as liquid hand dishwashing compositions, solid automatic dishwashing compositions, liquid automatic dishwashing compositions, and tab/unit does forms of automatic dishwashing compositions.

Quite typically, cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, an oxygen bleaching agent and a surfactant as described herein. A comprehensive list of suitable laundry or cleaning adjunct materials can be found in WO 99/05242.

Common cleaning adjuncts include builders, enzymes, polymers not discussed above, bleaches, bleach activators, catalytic materials and the like excluding any materials already defined hereinabove. Other cleaning adjuncts herein can include suds boosters, suds suppressors (antifoams) and the like, diverse active ingredients or specialized materials such as dispersant polymers (e.g., from BASF Corp. or Rohm & Haas) other than those described above, color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, chelating agents, dye transfer inhibiting agents, dispersants, brighteners, suds suppressors, dyes, structure elasticizing agents, fabric softeners, anti-abrasion agents, hydrotropes, processing aids, and other fabric care agents, surface and skin care agents. Suitable examples of such other cleaning adjuncts and levels of use are found in U.S. Pat. Nos. 5,576,282, 6,306,812 B1 and 6,326,348 B1.

Method of Use

The present invention includes a method for cleaning a targeted surface. As used herein "targeted surface" may include such surfaces such as fabric, dishes, glasses, and other cooking surfaces, hard surfaces, hair or skin. As used herein "hard surface" includes hard surfaces being found in a typical home such as hard wood, tile, ceramic, plastic, leather, metal, glass. Such method includes the steps of contacting the composition comprising the modified polyol compound, in neat form or diluted in wash liquor, with at least a portion of a targeted surface then optionally rinsing the targeted surface. Preferably the targeted surface is subjected to a washing step prior to the aforementioned optional rinsing step. For purposes of the present invention, washing includes, but is not limited to, scrubbing, wiping and mechanical agitation.

As will be appreciated by one skilled in the art, the cleaning compositions of the present invention are ideally suited for use in home care (hard surface cleaning compositions) and/or laundry applications.

The composition solution pH is chosen to be the most complimentary to a target surface to be cleaned spanning broad range of pH, from about 5 to about 11. For personal care such as skin and hair cleaning pH of such composition preferably has a pH from about 5 to about 8 for laundry cleaning compositions pH of from about 8 to about 10. The compositions are preferably employed at concentrations of from about 200 ppm to about 10,000 ppm in solution. The water temperatures preferably range from about 5° C. to about 100° C.

For use in laundry cleaning compositions, the compositions are preferably employed at concentrations from about 200 ppm to about 10000 ppm in solution (or wash liquor). The water temperatures preferably range from about 5° C. to about 60° C. The water to fabric ratio is preferably from about 1:1 to about 20:1.

The method may include the step of contacting a nonwoven substrate impregnated with an embodiment of the composition of the present invention As used herein "nonwoven substrate" can comprise any conventionally fashioned nonwoven sheet or web having suitable basis weight, caliper (thickness), absorbency and strength characteristics. Examples of suitable commercially available nonwoven substrates include those marketed under the tradename SONTARA® by DuPont and POLYWEB® by James River Corp.

As will be appreciated by one skilled in the art, the cleaning compositions of the present invention are ideally suited for use in liquid dish cleaning compositions. The method for using a liquid dish composition of the present invention comprises the steps of contacting soiled dishes with an effective amount, typically from about 0.5 ml. to about 20 ml. (per 25 dishes being treated) of the liquid dish cleaning composition of the present invention diluted in water.

EXAMPLES

Example 1

Granular Laundry Detergent

| Formula | A wt % | B wt % | C wt % | D wt % | E wt % |
|---|---|---|---|---|---|
| $C_{11-12}$ Linear alkyl benzene sulphonate | 13-25 | 13-25 | 13-25 | 13-25 | 9-25 |
| $C_{12-18}$ Ethoxylate Sulfate | — | — | 0-3 | — | 0-1 |
| $C_{14-15}$ alkyl ethoxylate (EO = 7) | 0-3 | 0-3 | — | 0-5 | 0-3 |
| Dimethyl hydroxyethyl lauryl ammonium chloride | — | — | 0-2 | 0-2 | 0-2 |
| $C_{8-10}-N^{+}(CH_3)_2-(CH_2CH_2)OH$ | 20-40 | — | 18-33 | 12-22 | 0-15 |
| Sodium tripolyphosphate K1 | | | | | |
| Zeolite | 0-10 | 20-40 | 0-3 | — | — |
| Silicate builder | 0-10 | 0-10 | 0-10 | 0-10 | 0-10 |
| Carbonate | 0-30 | 0-30 | 0-30 | 5-25 | 0-20 |
| Diethylene triamine penta acetate | 0-1 | 0-1 | 0-1 | 0-1 | 0-1 |
| Polyacrylate | 0-3 | 0-3 | 0-3 | 0-3 | 0-3 |
| Carboxy Methyl Cellulose | 0.2-0.8 | 0.2-0.8 | 0.2-0.8 | 0.2-0.8 | 0.2-0.8 |
| Grease Cleaning Alkoxylated Polyalkylenimine Polymer[1] | 1.0% | 1.0% | | 0.25% | 0.25% |
| Alkoxylated Polyalkanolamine Polymer[2] | | | 0.75% | | |
| Ethoxysulfated Hexamethylene Diamine Dimethyl Quat | — | 1.0% | 2.0% | 0.7% | 0.7% |
| Ethoxylated Hexamethylene Diamine Dimethyl Quat | | | | | |
| Soil Suspending Alkoxylated Polyalkylenimine Polymer[3] | | | | — | — |
| PEG-PVAc Polymer[4] | 1.0% | — | — | 0.3% | 0.3% |
| Percarbonate | 0-10 | 0-10 | 0-10 | 0-10 | 0-10 |
| Nonanoyloxybenzenesulfonate | — | — | 0-2 | 0-2 | 0-2 |
| Tetraacetylethylenediamine | — | — | 0-0.6 | 0-0.6 | 0-0.6 |
| Zinc Phthalocyanine Tetrasulfonate | — | — | 0-0.005 | 0-0.005 | 0-0.005 |
| Brightener | 0.05-0.2 | 0.05-0.2 | 0.05-0.2 | 0.05-0.2 | 0.05-0.2 |
| $MgSO_4$ | — | — | 0-0.5 | 0-0.5 | 0-0.5 |
| Enzymes | 0-0.5 | 0-0.5 | 0-0.5 | 0-0.5 | 0-0.5 |

-continued

| Formula | A wt % | B wt % | C wt % | D wt % | E wt % |
|---|---|---|---|---|---|
| Minors (perfume, dyes, suds stabilizers) | balance | balance | balance | balance | balance |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxlate groups per —OH.
[3]600 g/mol molecular weight polyethylenimine core with 20 ethoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

Example 2

Granular Laundry Detergent

Aqueous Slurry Composition.

| Component | % w/w Aqueous slurry |
|---|---|
| A compound having the following general structure: bis((C$_2$H$_5$O)(C$_2$H$_4$O)n)(CH$_3$)—N$^+$—C$_x$H$_{2x}$—N$^+$—(CH$_3$)—bis((C$_2$H$_5$O)(C$_2$H$_4$O)n), wherein n = from 20 to 30, and x = from 3 to 8, or sulphated or sulphonated variants thereof | 1.23 |
| Ethylenediamine disuccinic acid | 0.35 |
| Brightener | 0.12 |
| Magnesium sulphate | 0.72 |
| Acrylate/maleate copolymer | 6.45 |
| Grease Cleaning Alkoxylated Polyalkylenimine Polymer[1] | 0.30 |
| Ethoxysulfated Hexamethylene Diamine Dimethyl Quat | 0.70 |
| PEG-PVAc Polymer[4] | 0.30 |
| Linear alkyl benzene sulphonate | 11.92 |
| Hydroxyethane di(methylene phosphonic acid) | 0.32 |
| Sodium carbonate | 4.32 |
| Sodium sulphate | 47.49 |
| Soap | 0.78 |
| Water | 23.30 |
| Miscellaneous | 0.42 |
| Total Parts | 100.00 |

[1]600 g/mol molecular weight polyethylenimine core with 24 ethoxylate groups per —NH and 16 propoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

Preparation of a Spray-Dried Powder.

An aqueous slurry having the composition as described above is prepared having a moisture content of 25.89%. The aqueous slurry is heated to 72° C. and pumped under high pressure (from $5.5\times10^6 Nm^{-2}$ to $6.0\times10^6 Nm^{-2}$), into a counter current spray-drying tower with an air inlet temperature of from 270° C. to 300° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 1.0 wt %, a bulk density of 427 g/l and a particle size distribution such that 95.2 wt % of the spray-dried powder has a particle size of from 150 to 710 micrometers. The composition of the spray-dried powder is given below.

Spray-Dried Powder Composition.

| Component | % w/w Spray-dried powder |
|---|---|
| A compound having the following general structure: bis((C$_2$H$_5$O)(C$_2$H$_4$O)n)(CH$_3$)—N$^+$—C$_x$H$_{2x}$—N$^+$—(CH$_3$)—bis((C$_2$H$_5$O)(C$_2$H$_4$O)n), wherein n = from 20 to 30, and x = from 3 to 8, or sulphated or sulphonated variants thereof | 1.62 |
| Ethylenediamine disuccinic acid | 0.46 |
| Brightener | 0.16 |
| Magnesium sulphate | 0.95 |
| Acrylate/maleate copolymer | 8.45 |
| Grease Cleaning Alkoxylated Polyalkylenimine Polymer[1] | 0.75 |
| Ethoxysulfated Hexamethylene Diamine Dimethyl Quat | 0.75 |
| PEG-PVAc Polymer[4] | 0.69 |
| Linear alkyl benzene sulphonate | 15.65 |
| Hydroxyethane di(methylene phosphonic acid) | 0.42 |
| Sodium carbonate | 5.65 |
| Sodium sulphate | 61.98 |
| Soap | 1.02 |
| Water | 1.00 |
| Miscellaneous | 0.55 |
| Total Parts | 100.00 |

[1]600 g/mol molecular weight polyethylenimine core with 24 ethoxylate groups per —NH and 16 propoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

Preparation of an Anionic Surfactant Particle 1

The anionic detersive surfactant particle 1 is made on a 520 g batch basis using a Tilt-A-Pin then Tilt-A-Plow mixer (both made by Processall). 108 g sodium sulphate supplied is added to the Tilt-A-Pin mixer along with 244 g sodium carbonate. 168 g of 70% active $C_{25}E_3S$ paste (sodium ethoxy sulphate based on $C_{12/15}$ alcohol and ethylene oxide) is added to the Tilt-A-Pin mixer. The components are then mixed at 1200 rpm for 10 seconds. The resulting powder is then transferred into a Tilt-A-Plow mixer and mixed at 200 rpm for 2 minutes to form particles. The particles are then dried in a fluid bed dryer at a rate of 25001/min at 120° C. until the equilibrium relative humidity of the particles is less than 15%. The dried particles are then sieved and the fraction through 1180 μm and on 250 μm is retained The composition of the anionic detersive surfactant particle 1 is as follows:

25.0% w/w $C_{25}E_3S$ sodium ethoxy sulphate
18.0% w/w sodium sulphate
57.0% w/w sodium carbonate Preparation of a Cationic Detersive Surfactant Particle 1

The cationic surfactant particle 1 is made on a 14.6 kg batch basis on a Morton FM-50 Loedige mixer. 4.5 kg of micronised sodium sulphate and 4.5 kg micronised sodium carbonate are premixed in the Morton FM-50 Loedige mixer. 4.6 kg of 40% active mono-$C_{12-14}$ alkyl mono-hydroxyethyl di-methyl quaternary ammonium chloride (cationic surfactant) aqueous solution is added to the Morton FM-50 Loedige mixer whilst both the main drive and the chopper are operating. After approximately two minutes of mixing, a 1.0 kg 1:1 weight ratio mix of micronised sodium sulphate and micronised sodium carbonate is added to the mixer. The resulting agglomerate is collected and dried using a fluid bed dryer on a basis of 25001/min air at 100-140° C. for 30 minutes. The resulting powder is sieved and the fraction through 1400 μm is collected as the cationic surfactant particle 1. The composition of the cationic surfactant particle 1 is as follows:

15% w/w mono-$C_{12-14}$ alkyl mono-hydroxyethyl di-methyl quaternary ammonium chloride 40.76% w/w sodium carbonate 40.76% w/w sodium sulphate 3.48% w/w moisture and miscellaneous Preparation of a Granular Laundry Detergent Composition 10.84 kg of the spray-dried powder of example 2, 4.76 kg of the anionic detersive surfactant particle 1, 1.57 kg of the cationic detersive surfactant particle 1 and 7.83 kg (total amount) of other individually dosed dry-added material are dosed into a 1 m diameter concrete batch mixer operating at 24 rpm. Once all of the materials are dosed into the mixer, the mixture is mixed for 5 minutes to form a granular laundry detergent composition. The formulation of the granular laundry detergent composition is described below:

A Granular Laundry Detergent Composition.

| Component | % w/w granular laundry detergent composition |
|---|---|
| Spray-dried powder from earlier table in Example 2 | 43.34 |
| 91.6 wt % active linear alkyl benzene sulphonate flake supplied by Stepan under the tradename Nacconol 90 G ® | 0.22 |
| Citric acid | 5.00 |
| Sodium percarbonate (having from 12% to 15% active AvOx) | 14.70 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 4.35 |
| Suds suppressor agglomerate (11.5 wt % active) | 0.87 |
| Acrylate/maleate copolymer particle (95.7 wt % active) | 0.29 |
| Green/Blue carbonate speckle | 0.50 |
| Anionic detersive surfactant particle 1 | 19.04 |
| Cationic detersive surfactant particle 1 | 6.27 |
| Sodium sulphate | 3.32 |
| Solid perfume particle | 0.63 |
| Total Parts | 100.00 |

Example 3

Liquid Laundry Detergents

| Ingredient | A wt % | B wt % | C wt % | D wt % | E wt % | F wt % |
|---|---|---|---|---|---|---|
| Sodium alkyl ether sulfate | 14.4% | | 9.2% | 5.4% | | 16.0% |
| Linear alkylbenzene sulfonic acid | 4.4% | 12.2% | 5.7% | 1.3% | | 5.0% |
| Alkyl ethoxylate | 2.2% | 8.8% | 8.1% | 3.4% | | 0.8% |
| Amine oxide | 0.7% | 1.5% | | | | 0.7% |
| Citric acid | 2.0% | 3.4% | 1.9% | 1.0% | 1.6% | 3.0% |
| Fatty acid | 3.0% | 8.3% | | | 16.0% | 1.7% |
| Protease | 1.0% | 0.7% | 1.0% | | 2.5% | 1.3% |
| Amylase | 0.2% | 0.2% | | | 0.3% | 0.4% |
| Lipase | | | 0.2% | | | |
| Borax | 1.5% | 2.4% | 2.9% | | | 2.6% |
| Calcium and sodium formate | 0.2% | | | | | 0.2% |
| Formic acid | | | | | 1.1% | |
| Grease Cleaning Alkoxylated Polyalkylenimine Polymer[1] | 1.0% | 1.0% | | 0.25% | 0.25% | 1.3% |
| Alkoxylated Polyalkanolamine Polymer[2] | | | 0.75% | | | |
| Ethoxysulfated Hexamethylene Diamine Dimethyl Quat | — | 1.0% | 2.0% | 0.7% | 0.7% | 1.0% |
| Ethoxylated Hexamethylene Diamine Dimethyl Quat | | | | | | |
| Soil Suspending Alkoxylated Polyalkylenimine Polymer[3] | | | | — | — | 1.5% |
| PEG-PVAc Polymer[4] | 1.0% | — | — | 0.3% | 0.3% | |
| Sodium polyacrylate | | | | 0.2% | | |
| Sodium polyacrylate copolymer | | | 0.6% | | | |
| DTPA[5] | 0.1% | | | | 0.9% | 0.3% |
| DTPMP[6] | | 0.3% | | | | |
| EDTA[7] | | | | 0.1% | | |
| Fluorescent whitening agent | 0.15% | 0.2% | 0.12% | 0.12% | 0.2% | 0.2% |
| Ethanol | 2.5% | 1.4% | 1.5% | | | 2.0% |
| Propanediol | 6.6% | 4.9% | 4.0% | | 15.7% | 4.0% |
| Sorbitol | | | 4.0% | | | |
| Ethanolamine | 1.5% | 0.8% | 0.1% | | 11.0% | 2.0% |
| Sodium hydroxide | 3.0% | 4.9% | 1.9% | 1.0% | | 2.9% |
| Sodium cumene sulfonate | | 2.0% | | | | |
| Silicone suds suppressor | | 0.01% | | | | |
| Perfume | 0.3% | 0.7% | 0.3% | 0.4% | 0.6% | 0.5% |

-continued

| | | | | | | |
|---|---|---|---|---|---|---|
| Opacifier[8] | | 0.30% | 0.20% | | 0.50% | |
| Water | balance | balance | balance | balance | balance | balance |
| | 100.0% | 100.0% | 100.0% | 100.0% | 100.0% | 100.0% |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxlate groups per —OH.
[3]600 g/mol molecular weight polyethylenimine core with 20 ethoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[5]diethylenetriaminepentaacetic acid, sodium salt
[6]diethylenetriaminepentakismethylenephosphonic acid, sodium salt
[7]ethylenediaminetetraacetic acid, sodium salt
[8]Acusol OP 301

| Ingredent | G wt % | H wt % | I wt % | J wt % | K wt % | L wt % |
|---|---|---|---|---|---|---|
| Alkylbenzene sulfonic acid | 7 | 7 | 4.5 | 1.2 | 1.5 | 12.5 |
| Sodium C12-14 alkyl ethoxy 3 sulfate | 2.3 | 2.3 | 4.5 | 4.5 | 7 | 18 |
| C14-15 alkyl 8-ethoxylate | 5 | 5 | 2.5 | 2.6 | 4.5 | 4 |
| C12 alkyl dimethyl amine oxide | — | 2 | — | — | — | — |
| C12-14 alkyl hydroxyethyl dimethyl ammonium chloride | — | — | — | 0.5 | — | — |
| C12-18 Fatty acid | 2.6 | 3 | 4 | 2.6 | 2.8 | 11 |
| Citric acid | 2.6 | 2 | 1.5 | 2 | 2.5 | 3.5 |
| Protease enzyme | 0.5 | 0.5 | 0.6 | 0.3 | 0.5 | 2 |
| Amylase enzyme | 0.1 | 0.1 | 0.15 | — | 0.05 | 0.5 |
| Mannanase enzyme | 0.05 | — | 0.05 | — | — | 0.1 |
| Grease Cleaning Alkoxylated Polyalkylenimine Polymer[1] | 0.5 | 0.3 | | 0.25 | | 0.25 |
| Alkoxylated Polyalkanolamine Polymer[2] | | | 0.2 | | 0.25 | |
| Ethoxysulfated Hexamethylene Diamine Dimethyl Quat | — | 0.3 | 0.5 | | — | 0.7 |
| Ethoxylated Hexamethylene Diamine Dimethyl Quat | | | | | 0.7 | |
| Soil Suspending Alkoxylated Polyalkylenimine Polymer[3] | | | | 0.25 | 0.3 | |
| PEG-PVAc Polymer[4] | 0.5 | — | — | 1.0 | — | 0.3 |
| Alkoxylated Polyalkylenimine Polymer[1] | 1.0 | .8 | 1 | 0.4 | 1.5 | 2.7 |
| Diethylenetriaminepenta(methylenephosphonic) acid | 0.2 | 0.3 | — | — | 0.2 | — |
| Hydroxyethane diphosphonic acid | — | — | 0.45 | — | — | 1.5 |
| FWA | 0.1 | 0.1 | 0.1 | — | — | 0.2 |
| Solvents (1,2 propanediol, ethanol), stabilizers | 3 | 4 | 1.5 | 1.5 | 2 | 4.3 |
| Hydrogenated castor oil derivative structurant | 0.4 | 0.3 | 0.3 | 0.1 | 0.3 | — |
| Boric acid | 1.5 | 2 | 2 | 1.5 | 1.5 | 0.5 |
| Na formate | — | — | — | 1 | — | — |
| Reversible protease inhibitor[3] | — | — | 0.002 | — | — | — |
| Perfume | 0.5 | 0.7 | 0.5 | 0.5 | 0.8 | 1.5 |
| Buffers (sodium hydroxide, Monoethanolamine) | | | | To pH 8.2 | | |
| Water and minors (antifoam, aesthetics, . . . ) | | | | To 100 | | |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxlate groups per —OH.
[3]600 g/mol molecular weight polyethylenimine core with 20 ethoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

| Ingredient | M wt % | N wt % | O wt % | P wt % | Q wt % | R wt % |
|---|---|---|---|---|---|---|
| Alkylbenzene sulfonic acid | 5.5 | 2.7 | 2.2 | 12.2 | 5.2 | 5.2 |
| Sodium C12-14 alkyl ethoxy 3 sulfate | 16.5 | 20 | 9.5 | 7.7 | 1.8 | 1.8 |
| Sodium C12-14 alkyl sulfate | 8.9 | 6.5 | 2.9 | — | | |
| C12-14 alkyl 7-ethoxylate | | | | | 0.15 | 0.15 |
| C14-15 alkyl 8-ethoxylate | | | | | 3.5 | 3.5 |

-continued

| | | | | | | |
|---|---|---|---|---|---|---|
| C12-15 alkyl 9-ethoxylate | 1.7 | 0.8 | 0.3 | 18.1 | — | — |
| C12-18 Fatty acid | 2.2 | 2.0 | — | 1.3 | 2.6 | 2.6 |
| C itric acid | 3.5 | 3.8 | 2.2 | 2.4 | 2.5 | 2.5 |
| Protease enzyme | 1.7 | 1.4 | 0.4 | — | 0.5 | 0.5 |
| Amylase enzyme | 0.4 | 0.3 | — | — | 0.1 | 0.1 |
| Mannanase enzyme | | | | | 0.04 | 0.04 |
| Grease Cleaning Alkoxylated Polyalkylenimine Polymer[1] | 1.3 | 0.8 | 0.35 | 1.0 | | 0.25 |
| Alkoxylated Polyalkanolamine Polymer[2] | | | | | 0.25 | |
| Ethoxysulfated Hexamethylene Diamine Dimethyl Quat | — | 0.8 | 0.65 | 2.5- | — | 0.7 |
| Ethoxylated Hexamethylene Diamine Dimethyl Quat | | | | | 0.7 | |
| Soil Suspending Alkoxylated Polyalkylenimine Polymer[3] | | | | | 0.3 | |
| PEG-PVAc Polymer[4] | 0.8 | — | — | 1.0 | — | 0.3 |
| Diethylenetriaminepenta (methylenephosphonic) acid | | | | | 0.2 | 0.2 |
| FWA | — | — | — | — | .04 | .04 |
| Solvents (1,2 propanediol, ethanol, stabilizers | 7 | 7.2 | 3.6 | 3.7 | 1.9 | 1.9 |
| Hydrogenated castor oil derivative structurant | 0.3 | 0.2 | 0.2 | 0.2 | 0.35 | 0.35 |
| Polyacrylate | — | — | — | 0.1 | — | — |
| Polyacrylate copolymer[5] | — | — | — | 0.5 | — | — |
| Sodium carbonate | — | — | — | 0.3 | — | — |
| Sodium silicate | — | — | — | — | — | — |
| Borax | 3 | 3 | 2 | 1.3 | — | — |
| Boric acid | 1.5 | 2 | 2 | 1.5 | 1.5 | 1.5 |
| Perfume | 0.5 | 0.5 | 0.5 | 0.8 | 0.5 | 0.5 |
| Buffers (sodium hydroxide, monoethanolamine) | | | | | 3.3 | 3.3 |
| Water, dyes and miscellaneous | | | | Balance | | |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxlate groups per —OH.
[3]600 g/mol molecular weight polyethylenimine core with 20 ethoxylate groups per —NH.
PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[5]Alco 725 (styrene/acrylate)

Example 4

Liquid Dish Handwashing Detergents

| Composition | A | B |
|---|---|---|
| $C_{12-13}$ Natural AE0.6S | 29.0 | 29.0 |
| $C_{10-14}$ mid-branched Amine Oxide | — | 6.0 |
| $C1_{2-14}$ Linear Amine Oxide | 6.0 | — |
| SAFOL ® 23 Amine Oxide | 1.0 | 1.0 |
| $C_{11}E_9$ Nonionic[5] | 2.0 | 2.0 |
| Ethanol | 4.5 | 4.5 |
| Grease Cleaning Alkoxylated Polyalkylenimine Polymer[1] | 1.3 | — |
| Alkoxylated Polyalkanolamine Polymer[2] | — | 1.3 |
| Ethoxysulfated Hexamethylene Diamine Dimethyl Quat | 1.3 | 1.3 |
| PEG-PVAc Polymer[4] | 0.8 | 0.8 |
| Sodium cumene sulfonate | 1.6 | 1.6 |
| Polypropylene glycol 2000 | 0.8 | 0.8 |
| NaCl | 0.8 | 0.8 |
| 1,3 BAC Diamine[6] | 0.5 | 0.5 |
| Suds boosting polymer[7] | 0.2 | 0.2 |
| Water | Balance | Balance |

[1]600 g/mol molecular weight polyethylenimine core with 24 ethoxylategroups per —NH and 16 propoxylate groups per —NH.
[2]13,600 g/mol molecular weight triethanolamine condensate core with 24 ethoxylate groups per —OH and 16 propoxlate groups per —OH.

-continued

| Composition | A | B |
|---|---|---|

[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[5]Nonionic may be either $C_{11}$ Alkyl ethoxylated surfactant containing 9 ethoxy groups.
[6]1,3, BAC is 1,3 bis(methylamine)-cyclohexane.
[7](N,N-dimethylamino)ethyl methacrylate homopolymer

Example 5

Automatic Dishwasher Detergent

| | A | B | C | D | E |
|---|---|---|---|---|---|
| Polymer dispersant[5] | 0.5 | 5 | 6 | 5 | 5 |
| Carbonate | 35 | 40 | 40 | 35-40 | 35-40 |
| Sodium tripolyphosphate | 0 | 6 | 10 | 0-10 | 0-10 |
| Silicate solids | 6 | 6 | 6 | 6 | 6 |
| Bleach and bleach activators | 4 | 4 | 4 | 4 | 4 |
| Grease Cleaning Alkoxylated | 1.0% | 1.0% | | 0.25% | 0.25% |

-continued

| | A | B | C | D | E |
|---|---|---|---|---|---|
| Polyalkylenimine Polymer[1] | | | | | |
| Alkoxylated Polyalkanolamine Polymer[2] | | | 0.75% | | |
| Ethoxysulfated Hexamethylene Diamine Dimethyl Quat | — | 1.0% | 2.0% | 0.7% | 0.7% |
| Ethoxylated Hexamethylene Diamine Dimethyl Quat | | | | | |
| Soil Suspending Alkoxylated Polyalkylenimine Polymer[3] | | | | 0.3% | — |
| PEG-PVAc Polymer[4] | 1.0% | — | — | | 0.3% |
| Enzymes | 0.3-0.6 | 0.3-0.6 | 0.3-0.6 | 0.3-0.6 | 0.3-0.6 |
| Disodium citrate dihydrate | 0 | 0 | 0 | 2-20 | 0 |
| Nonionic surfactant[6] | 0 | 0 | 0 | 0 | 0.8-5 |
| Water, sulfate, perfume, dyes and other adjuncts | Balance to 100% | Balance to 100% | Balance to 100% | Balance to 100% | Balance to 100% |

[1]600 g/mol molecular weight polyethylenimine core with 24 ethoxylate groups per —NH and 16 propoxylate groups per —NH.
[2]13,600 g/mol molecular weight triethanolamine condensate core with 24 ethoxylate groups per —OH and 16 propoxlate groups per —OH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[5]Such as ACUSOL ® 445N available from Rohm & Haas or ALCOSPERSE ® from Alco.
[6]Such as SLF-18 POLY TERGENT from the Olin Corporation.

Example 6

Liquid Laundry Detergent Composition in the Form of a Pouch, being Encapsulated by a Film of Polyvinyl Alcohol

| | A | B 3 compartments pouched product | | |
|---|---|---|---|---|
| Compartment # | 1 | 1 | 2 | 3 |
| Dosage (g) | 36.0 | 34.0 | 3.5 | 3.5 |
| Alkylbenzene sulfonic acid | 14.5 | 14.5 | 20.0 | |
| C12-14 alkyl ethoxy 3 sulfate | 8.5 | 8.5 | | |
| C12-14 alkyl 7-ethoxylate | 12.5 | 12.5 | 17.0 | |
| C12-18 Fatty acid | 14.5 | 14.5 | 13.0 | |
| Protease enzyme | 1.5 | 1.5 | | |
| Amylase enzyme | 0.2 | | | |
| Mannanase enzyme | 0.1 | | | |
| PAP granule[1] | | | | 50.0 |
| Grease Cleaning Alkoxylated Polyalkylenimine Polymer[2] | 1.5 | 2.0 | | |
| Ethoxysulfated Hexamethylene Diamine Dimethyl Quat | | | 2.2 | |
| Soil Suspending Alkoxylated Polyalkylenimine Polymer[3] | 4.0 | 2.0 | | |
| PEG-PVAc Polymer[4] | | | 2.5 | |
| Hydroxyethane diphosphonic acid | 1.0 | 0.6 | 0.6 | |
| Brightener | 0.2 | 0.2 | 0.2 | |
| Solvents (1,2 propanediol, ethanol), stabilizers | 20 | 20 | 25 | 30.0 |

-continued

| | A | B 3 compartments pouched product | | |
|---|---|---|---|---|
| Compartment # | 1 | 1 | 2 | 3 |
| Hydrogenated castor oil derivative structurant | 0.1 | 0.05 | | |
| Perfume | 1.8 | 1.7 | | |
| Buffers (sodium hydroxide, monoethanolamine) | To pH 8.0 for liquid | | | |
| Water and minors (antioxidant, aesthetics, . . .) | To 100 p | | | |

[1]PAP = Phtaloyl-Amino-Peroxycaproic acid, as a 70% active wet cake
[2]600 g/mol molecular weight polyethylenimine core with 24 ethoxylate groups per —NH and 16 propoxylate groups per —NH.
[3]600 g/mol molecular weight polyethylenimine core with 20 ethoxylate groups per —NH.
[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

Unless otherwise noted, all component or composition levels are in reference to the active level of that component or composition, and are exclusive of impurities, for example, residual solvents or by-products, which may be present in commercially available sources.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent or cleaning composition which comprises a polymer system that comprises:

a) one or more amphiphilic alkoxylated grease cleaning polymers comprising a core structure and a plurality of alkylenoxy groups, wherein:

i) the core structure comprises a polyalkylenimine structure comprising, in condensed form, repeating units of formulae (I), (II), (III) and (IV):

(I)

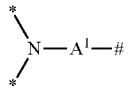

(II)

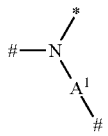

(III)

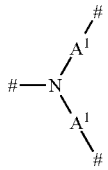

(IV)

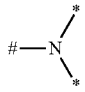

wherein # in each case denotes one-half of a bond between a nitrogen atom and the free binding position of a group $A^1$ of two adjacent repeating units of formulae (I), (II), (III) or (IV); * in each case denotes one-half of a bond to one of the alkoxylate groups; and $A^1$ is independently selected from linear or branched $C_2$-$C_6$-alkylene; wherein the polyalkylenimine structure consists of 1 repeating unit of formula (I), x repeating units of formula (II), y repeating units of formula (III) and y+1 repeating units of formula (IV), wherein x and y in each case have a value in the range of from 0 to about 150; where the average weight average molecular weight, Mw, of the polyalkylenimine core structure is a value in the range of from about 60 to about 10,000 g/mol; and the plurality of alkylenoxy groups are independently selected from alkylenoxy units of the formula (V)

(V)

$$*-[A^2-O]_m-[CH_2-CH_2-O]_n-[A^3-O]_p-R$$

wherein: * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50; or ii) the core structure comprises a polyalkanolamine structure of the condensation products of at least one compound selected from N-(hydroxyalkyl)amines of formulae (I.a), formulae (I.b), and combinations thereof, (I.a)

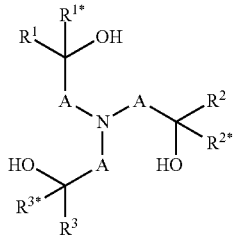

(I.b)

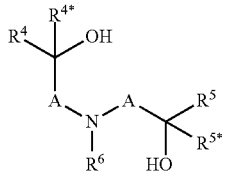

wherein A are independently selected from $C_1$-$C_6$-alkylene; $R^1$, $R^{1*}$, $R^2$, $R^{2*}$, $R^3$, $R^{3*}$, $R^4$, $R^{4*}$, $R^5$ and $R^{5*}$ are independently selected from hydrogen, alkyl, cycloalkyl or aryl, wherein the last three mentioned radicals may be optionally substituted; and $R^6$ is selected from hydrogen, alkyl, cycloalkyl or aryl, wherein the last three mentioned radicals may be optionally substituted; and the plurality of alkylenoxy groups are independently selected from alkylenoxy units of the formula (V)

(V)

$$*-[A^2-O]_m-[CH_2-CH_2-O]_n-[A^3-O]_p-R$$

wherein: * in each case denotes one-half of a bond to at least a part of the remaining hydroxy groups of the polyalkanolamine condensation product, at least a part of the secondary amino groups of the polyalkanolamine condensation product, if present, and combinations thereof; $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50, and either b) a clay soil cleaning polymer; or c) a soil suspending polymer.

2. A laundry detergent or cleaning composition according to claim 1 wherein the clay soil cleaning polymer is selected from the group consisting of ethoxylated oligamines, ethoxylated oligamine methyl quats, ethoxylated oligoamine benzyl quats, ethoxysulfated oligoamines methyl quats, propoxylated-ethoxysulfated oligoamine methyl quats, ethoxysulfated oligoamines benzyl quats, propoxylated-ethoxysulfated oligo amine benzyl quats, ethoxylated oligoetheramine methyl quats, ethoxylated oligoetheramine benzyl quats, ethoxysulfated oligoetheramines methyl quats, ethoxysulfated oligoetheramines benzyl quats, and mixtures thereof.

3. A laundry detergent or cleaning composition according to claim 2 wherein the clay soil cleaning polymer is selected from the group consisting of ethoxysulfated hexamethylene diamine dimethyl quat; ethoxylated tetraethylene pentaimine; ethoxylated hexamethylene diamine dimethyl quat;

bis(hexamethylene)triamine ethoxylated about 30 times per —NH group and quaternized about 90%; ethoxylated 4,9-dioxa-1,12-dodecanediamine dimethyl quat tetrasulfate; propoxylated-ethoxylated bis(hexamethylene)triamine; benzyl-quaternized bis(hexamethylene)triamine; trans-sulfated bis (hexamethylene)triamine; 50% sulfonated, propoxylated, ethoxylated methyl quat of hexamethylene diamine, and combinations thereof.

4. A laundry detergent or cleaning composition according to claim 1 wherein the soil suspending polymer is selected from the group consisting of:

i) alkoxylated polyethyleneimines having from about 5 to 24 ethoxylate groups per —NH group and from zero to about 12 propoxylate groups per —NH group; and ii) random graft copolymers having a hydrophilic backbone comprising monomers selected from the group consisting of unsaturated $C_{1-6}$ acids, ethers, alcohols, aldehydes, ketones or esters, sugar units, alkoxy units, maleic anhydride and saturated polyalcohols, and mixtures thereof; and hydrophobic side chains selected from the group comprising $C_{4-25}$ alkyl groups, polypropylene; polybutylene, a vinyl ester of a saturated monocarboxylic acid containing from 1 to 6 carbon atoms; a $C_{1-6}$ alkyl ester of acrylic or methacrylic acid; and iii) a mixture thereof.

5. A laundry detergent or cleaning composition according to claim 4 wherein the soil suspending polymer is a random graft copolymer having a hydrophilic backbone comprising polyethylene glycol of molecular weight from 4,000 to 15,000, and from 50% to 65% by weight hydrophobic side chains formed by polymerising at least one monomer selected from a vinyl ester of a saturated monocarboxylic acid containing from 1 to 6 carbon atoms and/or a $C_{1-6}$ alkyl ester of acrylic or methacrylic acid.

6. A laundry detergent or cleaning composition according to claim 5 wherein the soil suspending polymer is a random graft copolymer having a hydrophilic backbone comprising polyethylene glycol of molecular weight from 4,000 to 15,000, and from 50% to 65% by weight hydrophobic side chains formed by polymerising at least one monomer selected from vinyl acetate, vinyl propionate and/or butyl acrylate.

7. A laundry detergent or cleaning composition according to claim 4 wherein the soil suspending polymer is a water-soluble polyalkylene oxide graft base having side chains formed by polymerization of a vinyl ester component, said polymer having an average of $\leqq 1$ graft site per 50 alkylene oxide units and mean molar masses $M_w$ of from 3000 to 100,000 g/mol.

8. A laundry detergent or cleaning composition according to claim 7 wherein the graft polymer has a polydispersity $M_w/M_n$ of $\leqq 3$.

9. A laundry detergent or cleaning composition according to claim 1 wherein the detergent or composition further comprises a surfactant system.

10. A laundry detergent or cleaning composition according to claim 9 wherein the surfactant system comprises $C_{10}$-$C_{16}$ alkyl benzene sulfonates.

11. A laundry detergent or cleaning composition according to claim 9 wherein the surfactant system comprises $C_8$-$C_{18}$ linear alkyl sulfonate surfactant.

12. A laundry detergent or cleaning composition according to claim 10 wherein the surfactant system further comprises one or more co-surfactants selected from the groups consisting of nonionic surfactants, cationic surfactants, anionic surfactants and mixtures thereof.

13. A laundry detergent or cleaning composition according to claim 9 wherein the detergent or composition further comprises cleaning adjunct additives.

14. A cleaning implement comprising a nonwoven substrate and the laundry detergent or cleaning composition according to claim 1.

* * * * *